United States Patent [19]

Takagi et al.

[11] 4,386,497

[45] Jun. 7, 1983

[54] EXHAUST GAS CLEANING DEVICE FOR INTERNAL COMBUSTION ENGINE

[75] Inventors: Shigeru Takagi, Anjo; Yukihisa Takeuchi, Aichi; Shigeru Kamiya, Chiryu; Masahiro Tomita, Anjo; Kiyohiko Oishi, Susono; Kiyoshi Kobashi, Mishima, all of Japan

[73] Assignees: Nippon Soken, Inc., Nishio; Toyota Jidosha Kogyo Kabushiki Kaisha, Toyota, both of Japan

[21] Appl. No.: 275,511

[22] Filed: Jun. 19, 1981

[30] Foreign Application Priority Data

Jun. 30, 1980 [JP] Japan ..... 55-88640

[51] Int. Cl.[3] ..... F01N 3/02

[52] U.S. Cl. ..... 60/296; 60/311; 55/DIG. 30

[58] Field of Search ..... 60/295, 296, 288, 311, 60/303, 284, 286; 422/180; 55/DIG. 30, 283

[56] References Cited

U.S. PATENT DOCUMENTS

| | | | |
|---|---|---|---|
| 4,167,852 | 9/1979 | Ludecke . | |
| 4,279,864 | 7/1981 | Nara | 422/180 |
| 4,281,512 | 8/1981 | Mills | 55/283 |
| 4,345,431 | 8/1982 | Suzuki | 60/303 |

*Primary Examiner*—Douglas Hart

*Attorney, Agent, or Firm*—Cushman, Darby & Cushman

[57] ABSTRACT

An exhaust gas cleaning device comprises a casing provided with an inlet port which is communicated with an exhaust pipe of an internal combustion engine and an outlet port, two particulates collecting members disposed in two independent exhaust gas flowing passages which are communicated with the inlet port and the outlet port of the casing, a valve means provided on the downstream side of the two exhaust gas flowing passages for selectively passing the exhaust gases into either one of the exhaust gas flowing passages and a heated air supplying means provided on the downstream side of the collecting members for selectively supplying heated air into either one of the particulates collecting members.

12 Claims, 7 Drawing Figures

EXHAUST GAS CLEANING DEVICE FOR INTERNAL COMBUSTION ENGINE

BACKGROUND OF THE INVENTION

The present invention relates to an exhaust gas cleaning device for eliminating particulates such as carbon particles in exhaust gases of an internal combustion engine, particularly to an exhaust gas cleaning device provided with a particulates collecting member and heated air supplying means for burning the particulates collected by the particulates collecting member, in the exhaust gas passage.

The present invention more particularly relates to an exhaust gas cleaning device provided with two particulates collecting members which alternately collect particulates and having such a cleaning system that the particulates collected by one inactive particulates collecting member are burnt by the heated air supplying means while the products of combustion are recycled into the other active particulates collecting member.

FIG. 1 shows one example of such a conventional exhaust gas cleaning device as described above, which is disclosed in U.S. Pat. No. 4,167,852.

A housing 4 is provided with inlet ports 2 and an outlet port 3. The housing 4 is connected to an internal combustion engine 1 through the inlet ports 2. Exhaust gases discharged from the internal combustion engine 1 flow into the housing 4 through the inlet ports 2 and are discharged from the housing 4 through the outlet port 3. Within the housing 4, two independent exhaust gas flowing passages 51 and 52 are formed in parallel with each other. And in one end portion of the flowing passages 51 and 52, on the side of the inlet ports 2, an exhaust gas inlet chamber 6 is formed while in the other end portion of the flowing passages 51 and 52, on the side of the outlet port 3, an exhaust gas outlet chamber 7 is formed.

In each of the flowing passages 51 and 52, heat resistant filter members 81 and 82 which operate as particulates collecting members, are provided respectively.

And in the exhaust gas inlet chamber 6, a diverter valve means 9 for directing the flow of exhaust gases to either collecting member 81 or 82 is provided. Therefore, the exhaust gases containing particulates such as carbon particles discharged from the internal combustion engine 1 flow into the collecting member 81 as shown by hatched arrows, for example.

The conventional exhaust gas cleaning device is further provided with a nozzle 101 for injecting an air-fuel mixture and an ignition means 102 between each of the particulates collecting members 81 and 82 and the valve means 9.

The nozzle 101 and the ignition means 102 operate as the heated air supplying means for heating and burning the particulates collected by the inactive particulates collecting member 82.

A flow redirecting valve 11 is provided in the exhaust gas outlet chamber 7 for redirecting the combustion products collected in either one of the particulates collecting members 81 and 82 into the exhaust gas flowing passage communicated with the other particulates collecting member.

A recycling passage 12 is provided between the exhaust gas outlet chamber 7 and the exhaust gas inlet chamber 6 for recycling the flow of exhaust gases containing the combustion products which is directed by the flow redirecting valve 11 into the exhaust gas inlet chamber 6, to be joined into the flow of exhaust gases which flow into the active particulates collecting member. The heated air supplied by the heated air supplying means 101 and 102, is supplied into the inactive collecting member 82 as shown by a dotted line.

Then, the heated air containing the combustion products flows into the exhaust gas inlet chamber 6 through the recycling passage 12 and mixes with the incoming exhaust gases from the internal combustion engine 1. The combustion products recycled from the inactive collecting member 82 and the particulates in the exhaust gases are eliminated while passing the active collecting member 81 and the cleaned exhaust gases pass out from the outlet port 3 as shown by a white arrow.

When the amount of the collected particulates in the active collecting member reaches such a level as to restrict the flow of exhaust gases, a manual or automatic control device (not shown) changes the positions of the diverter valve means 9 and the flow redirecting valve 11 as shown respectively by imaginary lines so that the particulates collecting operation and particulates burning operation of the particulates collecting members are alternated with each other.

By burning the collected particulates collected by each of the particulates collecting members, the particulates collecting member is prevented from being clogged by the particulates.

And the combustion products which are formed in the inactive collecting member are cleaned by supplying the combustion products into the other active collecting member.

The conventional exhaust gas cleaning device as described above requires the diverter valve means 9, the flow redirecting means 11, and the recycling passage, and furthermore requires such a control device as to operate the diverter valve means 9 and the flow redirecting means 11 in combination with each other in order to recycle the gas containing the combustion products.

Therefore, the conventional exhaust gas cleaning device becomes large and heavy so that a large mounting space is required.

Accordingly, one object of the present invention is to provide a small sized and light weighted exhaust gas cleaning device having a simple construction, which overcomes the defects of the conventional exhaust gas cleaning device as described above.

DESCRIPTION OF THE DRAWINGS

Other objects and advantages of the invention will become apparent from the following description of embodiments with reference to the accompanying drawings wherein.

SUMMARY OF THE INVENTION

Figure 1:
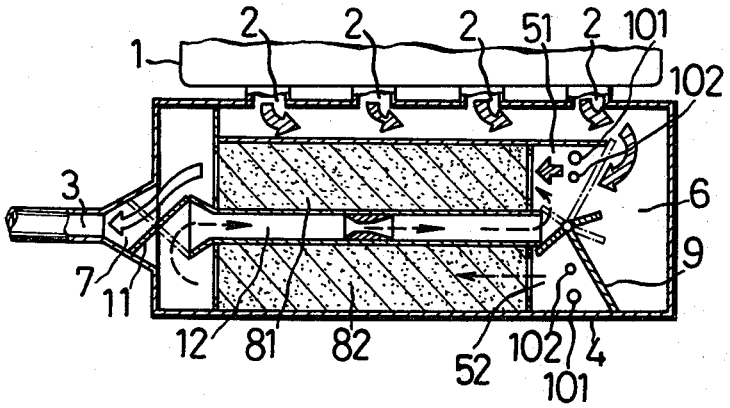
FIG.1 PRIOR ART
FIG. 1 is a longitudinally sectional view of a conventional device.

The exhaust gas cleaning device of the present invention comprises two particulates collecting members disposed in two independent exhaust gas flowing passages which are communicated with an inlet port and an outlet port of a casing of the device respectively, a diverter valve means 9 provided in the downstream junction of the exhaust gas flowing passages for selectively passing the exhaust gases into either one of the exhaust gas flowing passages, and a heated air supplying means provided on the downstream side of the collecting members for selectively supplying heated air into either one of the particulates collecting members.

According to the present invention, the flow redirecting valve of the conventional device can be omitted so that the device for operating the flow redirecting valve and the diverter valve means in combination with each other can be also omitted. Consequently, the exhaust gas cleaning device can be made small and light.

DETAILED DESCRIPTION OF THE INVENTION

Hereinafter, the present invention will be explained in detail in accordance with the embodiments shown in the drawings.

Figure 2:
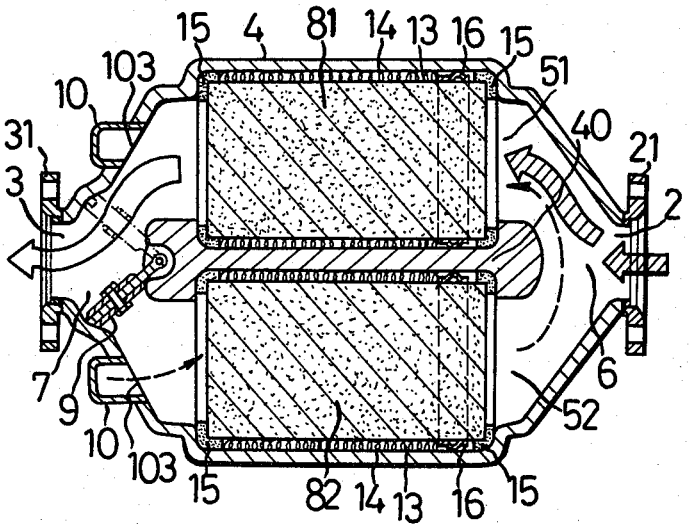
FIG. 2 is a longitudinal sectional view of a first embodiment of the present invention.

FIG. 2 shows a first embodiment of the present invention.

The exhaust gas cleaning device of the first embodiment is composed of a casing 4 provided with an inlet port 2 through which the exhaust gases discharged from an internal combustion engine flow into the casing 4 and an outlet port 3 through which the cleaned exhaust gases flow out of the casing 4.

Within the casing 4, a first and a second exhaust gas flowing passages 51 and 52 which are separated from each other by a partition wall 40 and which are communicated with the inlet port 2 and the outlet port 3 respectively, are formed.

The flowing passages 51 and 52 are diverged from each other on the upper stream side thereof in an exhaust gas inlet chamber 6 and are joined with each other on the downstream side thereof in an exhaust gas outlet chamber 7. And in each of the exhaust gas flowing passages 51 and 52, particulates collecting members 81 and 82 are provided respectively. And in the outlet chamber 7, a valve means 9 is provided for directing most part of the exhaust gas flow from the inlet port 2 to the outlet chamber 7 through the first collecting member 81 (or the second collecting member 82) and blocking the exhaust gas flow passing through the second collecting member 82 (or the first collecting member 81).

And on the walls of the casing 4 in the outlet chamber 7, heated air blowing ports 103 of a heated air supplying means 10 are provided for heating the particulates such as carbon particles collected by each of the collecting members 81 and 82 up to the combustion temperature thereof so that the particulates are intermittently burnt off.

The exhaust gas cleaning device of the first embodiment is interposed between exhaust pipes (not shown) to which flange portions 21 and 31 of the inlet port 2 and the outlet port 3 are connected respectively.

The casing 4 comprises a pair of cylindrical portions by which the first and the second exhaust gas flowing passages 51 and 52 are formed. And these cylindrical portions are connected to each other by the partition wall 40. Within the cylindrical portions, columnar particulates collecting members 81 and 82 are provided respectively.

These particulates collecting members 81 and 82 are made of heat resistant body such as foamed ceramic and ceramic honeycomb structure which is provided with a large number of such open passages as to collect the carbon particulates while the exhaust gases pass therethrough.

Between the outer peripheral surface of each of the collecting members 81 and 82 and the inner peripheral surface of the casing 4 and the partition wall 40, a space portion 13 is formed. Within each space portion 13, a shock absorbing member 14 made of a metallic wire is disposed for preventing the collecting members 81 and 82 from being damaged due to shock applied thereto.

Each shock absorbing member 14 radially supports the collecting members 81 and 82.

And between the casing 4 and each of the peripheral edge portions of both ends of the collecting members 81 and 82, an annular metallic fine wire fabric 15 is press-inserted for absorbing vibrations and shock applied to the collecting members 81 and 82 in the axial direction thereof.

In one portion of each space portion 13, an annular sealing member 16 is press-inserted for preventing the uncleaned exhaust gases from being discharged through each space portion 13.

Figure 6:
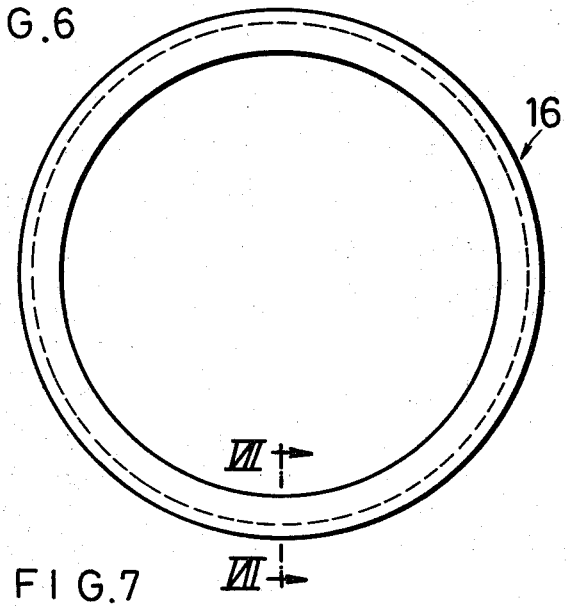
FIG. 6 is a front view of a sealing member to be used in the device of the present invention.
Figure 7:
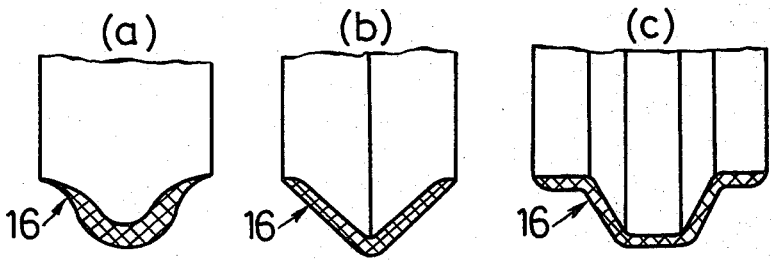
FIG. 7 is sectional views of examples of the sealing member, taken along the line VII—VII of FIG. 6.

Each sealing member 16 has an annular shape as shown in FIG. 6 and is formed by compressing a metallic wire fabric, such as inconel or stainless steel fine wire fabric having a diameter of about 0.1 to 0.15 mm, into about 4 g/cm$^3$ of bulk density. And each sealing member 16 is formed so as to have a saddle shape such as a wave shape, a V-shape or a trapezoid in radial cross section as shown in FIGS. 7(*a*), (*b*), and (*c*), for example.

By forming the sealing member 16 into such a shape as described above, large elasticity can be obtained so that each sealing member 16 is closely contacted with each of the collecting members 81 and 82 to exhibit excellent sealing effect.

The valve means 9 is pivotally fixed to one end of the partition wall 40 in the outlet chamber 7 so that a free end of the valve means 9 is contacted with the inner surface of the casing 4.

The valve means 9 having the above described construction allows the exhaust gases to flow out of either one of the collecting members 81 and 82 while intercepting the exhaust gases flowing from the other collecting member.

This valve means 9 is operated manually or by means of a control device.

As the heated air supplying means 10, a burner or an electric heat wire heater may be employed.

The manner of operation of the first embodiment described above will now be explained.

When the valve means 9 opens the first flowing passage 51 wherein the first collecting member 81 is disposed while closing the second flowing passage 52 wherein the second collecting member 82 is disposed as shown in FIG. 2, the exhaust gases containing particulates discharged from the internal combustion engine flow into the first collecting member 81 as shown by hatched arrows and flow out from the outlet port 3 as shown by a white arrow after being cleaned in the first collecting member 81.

While the exhaust gases flow through the first collecting member 81, the heated air supplying means 10 is operated to supply a heated air from the heated air blowing port 103 into the second collecting member 82 wherein the carbon particulates are previously collected, as shown by a dotted arrow. Then, the carbon particulates collected by the second collecting member 82 are heated to be burnt, and, consequently combustion products are formed.

The heated air flowing out of the second collecting member 82 containing the combustion products is joined into the incoming exhaust gases flowing into the first collecting member 81, as shown by a dotted arrow. Consequently, the combustion products are passed through the first collecting member 81 and cleaned.

When the amount of the particulates collected by the first collecting member 81 reaches such a predetermined level as to restrict the exhaust gas flow, the manual or automatic control device (not shown) is operated to change the position of the valve means 9 as shown by an imaginary line.

Then, the exhaust gases are supplied to the second collecting member 82 which was previously cleaned by burning the particulates thereof. The combustion products produced by burning the particulates collected by the first collecting member 81, are recycled into the second collecting member 82 together with the heated air for cleaning particulates therein in the manner previously described.

According to the exhaust gas cleaning device having the above described construction, the conventional redirecting valve 11 and the conventional recycling passage 12 are unnecessary. Therefore, the number of parts of the device can be decreased so that a small sized and light weighted exhaust gas cleaning device having excellent exhaust gas cleaning function can be obtained.

Furthermore, by using the annular sealing members 16, the exhaust gases can be certainly prevented from leaking through the space portions 13.

Figure 3:
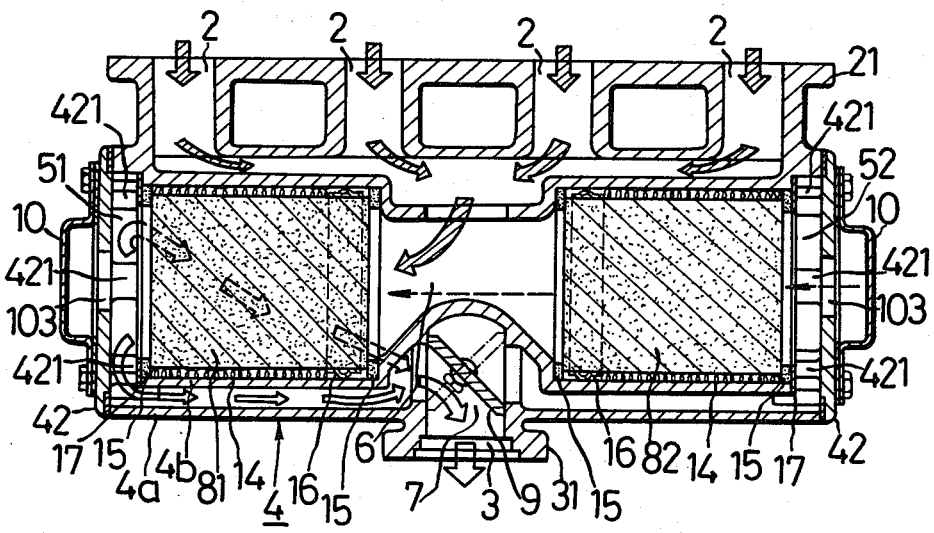
FIG. 3 is a longitudinal sectional view of a second embodiment of the present invention.
Figure 4:
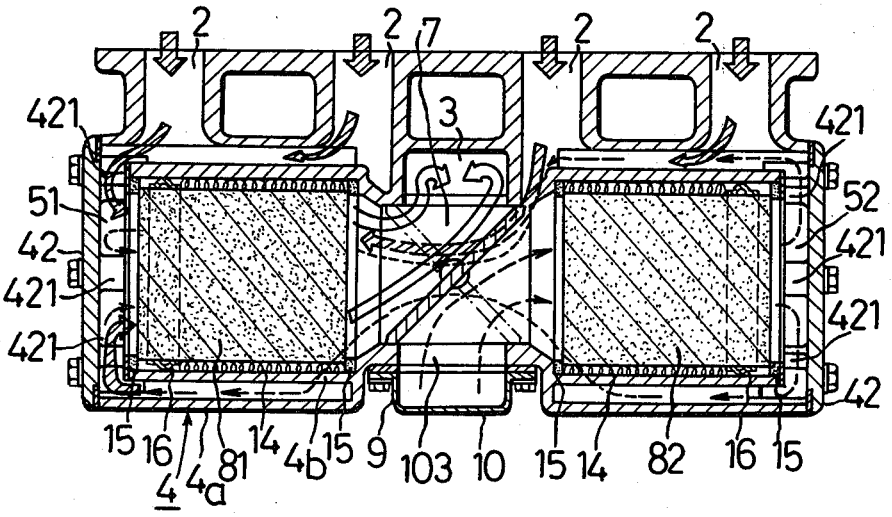
FIG. 4 is a longitudinal sectional view of a third embodiment of the present invention.

FIG. 3 and FIG. 4 show a second embodiment and a third embodiment of the present invention respectively.

The exhaust gas cleaning device of each of the second embodiment and the third embodiment is integrally formed with the exhaust manifold.

In the second embodiment shown in FIG. 3, the casing 4 is provided with inlet ports 2 and an outlet port 3 for the exhaust gases. The inlet ports 2 are connected to an exhaust port portion (not shown) of an internal combustion engine through the flange 21 thereof. The outlet port 3 is connected to an exhaust pipe (not shown) through the flange 31 thereof.

The casing 4 is composed of an outer cylinder **4*a* and an inner cylinder 4*b*. Within the inner cylinder 4*b*, columnar particulates collecting members 81 and 82 coaxially opposed to each other are disposed. Between the opposed end surfaces of the collecting members 81 and 82, an exhaust gas inlet chamber 6 leading to the inlet ports 2 is formed. The space formed between the outer cylinder 4*a* and the inner cylinder 4*b* is divided into a passage which introduces the exhaust gases into the inlet chamber 6 and a passage which introduces the exhaust gases flowing out of the collecting members 81 and 82 into the outlet port 3**.

To both opening ends of the casing 4, crown-shaped caps 42 provided with a plurality of projecting portions 421 which presses the collecting members 81 and 82 in the axial direction thereof through metallic plates 17 are fixed respectively.

Each cap 42 is provided with a blowing port 103 of the heated air supplying means 10, which leads to each of the collecting members 81 and 82.

In the outer periphery of each of the collecting members 81 and 82, a shock absorbing member 14 and an annular sealing member 16 are provided and each of the collecting members is axially supported by cushion members 15.

In the central portion of the space formed between the outer cylinder **4*a* and the inner cylinder 4*b*, the exhaust gas outlet chamber 7 leading to the outlet port 3 is formed. And in the exhaust gas outlet chamber 7, the valve means 9** is disposed.

In the exhaust gas cleaning device of the present invention having the above described construction, when the valve means 9 is positioned so as to allow the exhaust gases to flow out of the collecting member 81 as shown in FIG. 3, the exhaust gases containing particulates which flow from the inlet ports 2 into the inlet chamber 6 as shown by hatched arrows, flow into the collecting member 81 provided in the flowing passage 51 and the particulates are eliminated by the collecting member 81. Then, the cleaned exhaust gases pass through the space between the outer cylinder **4*a* and the inner cylinder 4*b*, and the outlet chamber 7, and is discharged from the outlet port 3**.

And the heated air is supplied from the heated air supplying means 10 into the collecting member 82 disposed within the flowing passage 52 to burn the previously collected particulates. The formed combustion products flow into the inlet chamber 6 as shown by a dotted arrow, and is joined into the incoming exhaust gas flowing from the inlet ports 2. Then the exhaust gases and the combustion products flow into the collecting member 81 and are discharged from the outlet port 3 after being cleaned in the collecting member 81.

In the third embodiment shown in FIG. 4, the casing 4 is composed of an outer cylinder **4*a* and an inner cylinder 4*b***.

Within the inner cylinder **4*b*, flowing passages 51 and 52 are formed and particulates collecting members 81 and 82 are disposed within the flowing passages 51 and 52** respectively.

The space formed between the outer cylinder **4*a* and the inner cylinder 4*b* is communicated with the inlet ports 2 and both open ends of the inner cylinder 4*b***.

Between the opposed ends of the collecting members 81 and 82, the exhaust gas outlet chamber 7 is formed so as to lead to the outlet port 3.

And in the outlet chamber 7, a valve means 9 is provided for opening or intercepting the passage between the opposed open ends of the collecting members 81 and 82 and the exhaust gas outlet port 3. In the outlet chamber 7, a heated air blowing port 103 of the heated air supplying means 10 opens. An exhaust gas inlet chamber 6 is provided under the outlet chamber 7 in parallel with each other. The construction of the supporting, sealing and absorbing means for the collecting members 81 and 82 are substantially similar to that of the above second embodiment.

When the valve means 9 is positined as shown in FIG. 4, the exhaust gases flowing from the inlet ports 2 enters the space between the outer cylinder **4*a* and the inner cylinder 4*b*** as shown by hatched arrows.

Then, the exhaust gases flow into the inside of the collecting member 81 from the outside end thereof, and after being cleaned by the collecting member 81, discharged from the outlet port 3 through the outlet chamber 7 as shown by white arrows.

The heated air flows into the collecting member 82 from the inside end thereof through the outlet chamber 7 as shown by dotted arrows to burn the particulates previously collected in the collecting member 82.

The formed combustion products flow out of the collecting member 82 from the outside end thereof and is joined into the exhaust gases flowing into the collecting member from the space between the outer cylinder 4*a* and the inner cylinder 4*b* to be collected by the collecting member 81.

Figure 5:
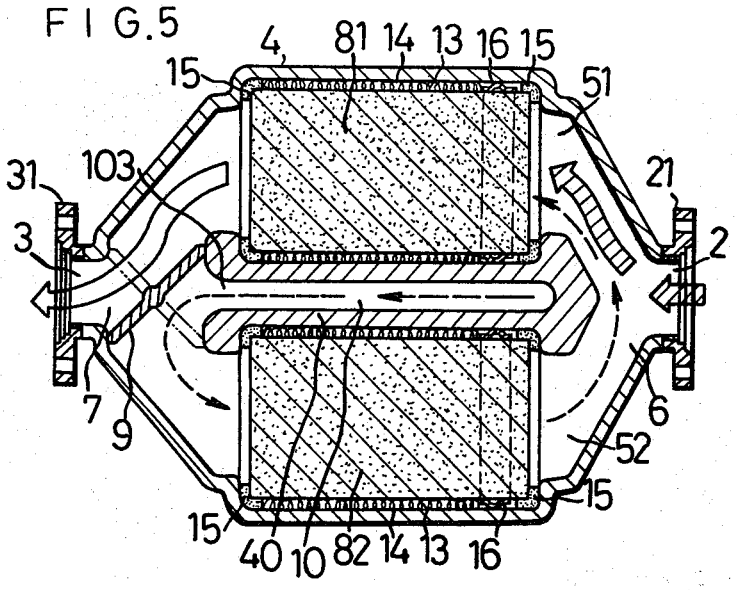
FIG. 5 is a longitudinal sectional view of a fourth embodiment of the present invention.

FIG. 5 shows a fourth embodiment of the present invention.

In the exhaust gas cleaning device of the fourth embodiment, a heated air blowing port 103 of the heated air supplying means 10 is provided in the partition wall 40 which separates the flowing passages 51 and 52 formed within the casing 4.

Other construction of the fourth embodiment is substantially similar to that of the first embodiment.

According to the third and the fourth embodiments having the above described construction, the heated air supplying means 10 and the heated air blowing port 103 can be utilized for supplying the heated air into both of the particulates collecting members 81 and 82, so that the exhaust gas cleaning device can be made small and the construction thereof can be made simple.

As described above, the exhaust gas cleaning device of the present invention comprises a casing wherein two independent exhaust gas flowing passages are formed, particulates collecting members which are provided in the exhaust gas flowing passages respectively, a valve means which is provided in the portion wherein the exhaust gas flowing passages are joined to each other and lead to the exhaust gas outlet port, for alternately communicating each of the exhaust gas flowing passages with the exhaust gas outlet port, and a heated air supplying means for supplying heated air into both flowing passages from the downstream side.

By operating the valve means, the exhaust gas can be alternately flowed into both exhaust gas flowing passages.

And by supplying heated air into the exhaust gas flowing passage which is intercepted by the valve means, the particulates previously collected by the collecting member provided in the intercepted flowing passage are burnt off.

The combustion products produced after the particulates are burnt off, flow into the upper stream side of the collecting member together with the heated air and are joined with the incoming exhaust gases flowing into the other collecting member. Consequently, the combustion products are collected by the other collecting member.

In the conventional cleaning device of this type, a valve means is provided on the side of the inlet ports of both exhaust gas flowing passages, a means for directing heated air into one of the exhaust gas flowing passage is provided on the side of the outlet port thereof and a recycling passage for supplying heated air containing combustion products from the side of the outlet port to the side of the inlet ports thereof is provided.

According to the present invention, since the valve means is provided in the exhaust gas outlet chamber on the down stream side of both exhaust gas flowing passages, it is unnecessary to provide the heated air directing means and the recycling passage. Therefore, the exhaust gas cleaning device can be made simple and small.

Thus, the exhaust gas cleaning device can be installed in a limited space of a vehicle with improved practical effect.

Having now fully described the invention, it will be apparent to one of ordinary skill in the art that many changes and modifications can be made thereto without departing from the spirit or scope of the invention as set forth herein.

What is claimed is:

1. An exhaust gas cleaning device for collecting and burning particulates contained within exhaust gases discharged from an internal combustion engine, comprising:

a casing provided with at least one inlet port and an outlet port for said exhaust gases;

a pair of particulates collecting members for collecting said particulates, which are made of heat resistant material having air permeability;

each of said collecting members being disposed within said casing to form an independent exhaust gas passage between said inlet port and said outlet port;

a valve means for alternately passing said exhaust gases flowed into said casing from said inlet port, through each of said collecting members;

said valve means being provided in an exhaust gas outlet chamber which is formed between each end of said collecting members on the downstream side and said outlet port for intercepting the passage between one of said collecting members and said outlet port while opening the passage between the other collecting member and said outlet port; and a heated air supplying means for burning said particulates collected by said collecting members, which opens into said exhaust gas outlet chamber formed within said casing;

said heated air supplying means supplying heated air into one collecting member through which said exhaust gases are prevented from passing into said outlet port so that said particulates previously collected by said one collecting member are burnt off and combustion products are flowed into said exhaust gases entering into the other collecting member.

2. An exhaust gas cleaning device according to claim 1, wherein:

said collecting members are disposed in parallel with each other from the side of said inlet port to the side of said outlet port; and an exhaust gas inlet chamber is formed between said inlet port and ends of said collecting members on the side of said inlet port.

3. An exhaust gas cleaning device according to claim 2, wherein:

said heated air supplying means comprises a pair of openings which open into said exhaust gas outlet chamber between each end of said collecting members on the down stream side thereof and said outlet port respectively so as to supply heated air into said collecting member through which said exhaust gases are prevented from passing, intercepted by said valve means.

4. An exhaust gas cleaning device according to claim 2, wherein:

said heated air supplying means is provided with one opening opening into said exhaust gas outlet chamber so as to be communicated with the space formed between said valve means and each end of said collecting members.

5. An exhaust gas cleaning device according to claim 1, wherein:

said collecting members are coaxially disposed within said casing.

6. An exhaust gas cleaning device according to claim 5, wherein:

an exhaust gas inlet chamber is formed between opposed ends of said collecting members so as to be communicated with said inlet port;

said exhaust gas outlet chamber is formed between said opposed ends of said collecting members, separated from said exhaust gas inlet chamber by a partition wall;

said exhaust gas outlet chamber is communicated with each outside end of said collecting members, through the space formed between the inner surface of said casing and each outer surface of said collecting members; and said heated air supplying means is provided in both ends of said casing respectively so as to open into said outside ends of said collecting members.

7. An exhaust gas cleaning device according to claim 5, wherein:

said exhaust gas outlet chamber is formed between opposed ends of said collecting members so as to be communicated with said outlet port;

said inlet port is communicated with each outside end of said collecting members through the space formed between the inner surface of said casing and each outer surface of said collecting members; and said heated air supplying means is provided so as to open into said exhaust gas outlet chamber.

8. An exhaust gas cleaning device according to claim 7, wherein:

said casing is composed of a cylindrical outer casing and closed ends and a cylindrical inner casing having open ends;

said collecting members are disposed within both end portions of said inner casing coaxially; and said space is formed between said outer casing and said inner casing.

9. An exhaust gas cleaning device according to claim 1, wherein:

said collecting members are made of foamed ceramic or ceramic honeycomb structure respectively.

10. An exhaust gas cleaning device according to claim 1, wherein:

between the outer peripheral surface of each of said collecting members and the inner peripheral surface of said casing, a heat resistant shock absorbing member and at least one annular heat resistant sealing member are interposed.

11. An exhaust gas cleaning device according to claim 10, wherein:

said shock absorbing member is made of metalic wire.

12. An exhaust gas cleaning device according to claim 11, wherein:

said sealing member is formed by compressing a metallic wire fabric into a saddle shape in radial cross section.

* * * * *